United States Patent [19]

Ames et al.

[11] Patent Number: 4,964,922

[45] Date of Patent: Oct. 23, 1990

[54] METHOD FOR DOMAIN REFINEMENT OF ORIENTED SILICON STEEL BY LOW PRESSURE ABRASION SCRIBING

[75] Inventors: S. Leslie Ames, Sarver; Jeffrey M. Breznak, New Kensington, both of Pa.

[73] Assignee: Allegheny Ludlum Corporation, Pittsburgh, Pa.

[21] Appl. No.: 382,366

[22] Filed: Jul. 19, 1989

[51] Int. Cl.[5] ..... H01F 1/04

[52] U.S. Cl. ..... 148/111; 148/113

[58] Field of Search ..... 148/110, 111, 112, 113; 72/54, 56

[56] References Cited

U.S. PATENT DOCUMENTS

| | | | |
|---|---|---|---|
| 3,647,575 | 3/1972 | Fiedler et al. | 148/111 |
| 3,990,923 | 11/1976 | Takashina et al. | 148/111 |
| 4,513,597 | 4/1985 | Kimotoo et al. | 72/53 |
| 4,548,656 | 10/1985 | Kimoto et al. | 148/111 |
| 4,680,062 | 7/1987 | Shen et al. | 148/111 |
| 4,737,203 | 4/1988 | Shen et al. | 148/111 |

FOREIGN PATENT DOCUMENTS

| | | |
|---|---|---|
| 61-130679 | 6/1986 | Japan . |
| 61-133321 | 6/1986 | Japan . |
| 61-284529 | 12/1986 | Japan . |
| 62-51202 | 3/1987 | Japan . |
| 2140432 | 3/1983 | United Kingdom . |
| 2167324 | 5/1985 | United Kingdom . |

*Primary Examiner*—John P. Sheehan

*Attorney, Agent, or Firm*—Patrick J. Viccaro

[57] ABSTRACT

Grain-oriented silicon steel having an insulation coating such as a forsterite layer on its outer surface, on which is scribed by a low pressure abrasion technique a predetermined pattern of stripes to expose the metal substrate, in a manner that little or no effect will be experienced with respect to magnetic properties, but will constitute essential preparation for improvement in properties when chemical treatment of the exposed metal stripes is performed.

10 Claims, 2 Drawing Sheets

METHOD FOR DOMAIN REFINEMENT OF ORIENTED SILICON STEEL BY LOW PRESSURE ABRASION SCRIBING

BACKGROUND OF THE INVENTION

This invention relates to the production of grain-oriented silicon steel having very low core losses by a procedure employing low pressure abrasion scribing of the forsterite layer of the steel to permit a chemical and annealing treatment to obtain a heat-proof domain refinement of the steel.

DESCRIPTION OF THE PRIOR ART

There has been a long history in the steel industry of the production of steel containing 2.5 to 4% of silicon for electrical purposes. The premium grades are of the so-called grain-oriented variety. Grain-oriented silicon steel is conventionally used in electrical applications, such as power transformers, distribution transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture (100) [001] in terms of Miller's indices, results in improved magnetic properties, particularly permeability and core loss over non-oriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically of 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperatures in order to produce the desired secondary recrystallization and purification treatment to remove impurities such as nitrogen and sulfur. The development of the cube-on-edge orientation is dependent upon the mechanism of secondry recrystallization wherein during recrystallization, secondary cube-on-edge oriented grains are preferentially grown at the expense of primary grains having a different and undesirable orientation.

The final texture annealed grain- oriented silicon steel sheet has an insulation coating thereon resulting from an annealing separator coating, i.e. refractory oxide base coating, applied before the texture anneal to stop the laps of the oil from thermally welding or sticking together during the high temperature anneal and to promote formation of an oxide film on the steel surface. This film is desirable because it is an electrical insulator and can form part, or sometimes all, of the insulation needed when the steel is in operation in a transformer. Such an insulative oxide coating forming naturally during the texture anneal is known variously as forsterite, the base coating, or mill glass.

As used herein, "sheet" and "strip" are used interchangeably and mean the same unless otherwise specified.

It is also known through the efforts of many prior art workers, that cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1850 at 10 Oersteds with a core loss of greater than 0.400 watts per pound (WPP) at 1.5 Tesla at 60 Hertz for nominally 9-mil material. High permeability grain-oriented silicon steels are characterized by higher permeabilities which may be the result of compositional changes alone or together with process changes. For example, high permeability silicon steels may contain nitrides, sulfides, and/or borides which contribute to the precipitates and inclusions of the inhibition system which contributes to the properties of the final steel product. Furthermore, such high permeability silicon steels generally undergo heavier cold rolling reduction to final gauge than regular grain-oriented steels for a final heavy cold reduction on the order of greater than 80% is made in order to facilitate the high permeability grain orientation. While such higher permeability material are desirable, such materials tend to produce larger magnetic domains than conventional material. Larger domains are deleterious to core loss.

Larger domains are also favored by lighter gauge. In other words, if one compares a 7 mil and a 9 mil material at identical permeability, the 7 mil sample will have larger domain size.

It is known that one of the ways that domain size and thereby core loss values of electrical steels may be reduced is if the steel is subjected to any of various practices designed to induce localized strains in the surface of the steel. Such practices may be generally referred to as "domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes, generally spaced at regular intervals. The scribe lines are substantially transverse to the rolling direction and typically are applied to only one side of the steel. See U.S. Pat. Nos. 3,647,575 issued Mar. 7, 1972; 4,513,597 issued Apr. 30, 1985; and 4,680,062 issued July 14, 1987.

In fabricating electrical steels into transformers, the steel inevitably suffers some deterioration in core loss quality due to cutting, bending, and construction of cores during fabrication, all of which impart undesirable stresses in the material. During fabrication incident to the production of stacked core transformers and, more particularly, in the power transformers of the United States, the deterioration in core loss quality due to fabrication is not so severe that a stress relief anneal (SRA), typically about 1475° F. (801° C.), is essential to restore usable properties. For such end uses there is a need for a flat, domain-refined silicon steel which need not be subjected to stress relief annealing. In other words, the scribed steel used for this purpose does not have to possess domain refinement which is heat resistant.

However, during the fabrication incident to the production of most distribution transformers in the United States, the steel strip is cut and subjected to various bending and shaping operations which produce more working stresses in the steel than in the case of power transformers. In such instances, it is necessary and conventional for manufacturers to stress relief anneal (SRA) the product to relieve such stresses. During stress relief annealing it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

It is known in the art of making electrical steel to attempt to produce heat resistant domain refinement. It has been suggested in prior patent art that contaminants or intruders may be effective in refining the magnetic domain wall spacing of grain-oriented silicon steel. U.S. Pat. No. 3,990,923-Takashina et al., dated Nov. 9, 1976, discloses that chemical treatment may be used on primary recrystallized silicon steel (i.e. before final texture annealing) to control or inhibit the growth of secondary recrystallization grains. British Patent Application No. 2,167,324A discloses a method of subdividing magnetic domains of grain-oriented silicon steels to survive a SRA. The method includes imparting a strain to the sheet, forming an intruder on the grain-oriented sheet, the intruder being of a different component or structure than the electrical sheet and doing so either prior to or after straining and thereafter annealing such as in a hydrogen reducing atmosphere to result in imparting the intruders into the steel body. Numerous metals and non-metals are identified as suitable intruder materials.

Japanese Patent Document 61-133321A discloses removing surface coatings from final texture annealed magnetic steel sheet, forming permeable material coating on the sheet and heat treating to form material having components or structure different than those of the steel matrix at intervals which provide HRDR.

Japanese Patent Document 61-139679A discloses a process of coating final texture annealed oriented magnetic steel sheet in the form of linear or spot shapes, at intervals with at least one compound selected from the group of phosphoric acid, phosphates, boric acid, borates, sulfates, nitrates, and silicates, and thereafter baking at 300°-1200° C., and forming a penetrated body different from that of the steel to refine the magnetic domains.

Japanese Patent Document No. 61-284529A discloses a method of removing the surface coatings from final texture annealed magnetic steel sheets at intervals, coating one or more of zinc, zinc alloys, and zincated alloy at specific coating weights, coating with one or more of metals having a lower vapor pressure than zinc, forming impregnated bodies different from the steel in composition or in structure at intervals by heat treatment or insulating film coating treatment to refine the magnetic domains.

Japanese Patent Document No. 62-51202 discloses a process for improving the core loss of silicon steel by removing the forsterite film formed after final texture annealing, and adhering different metal, such as copper, nickel, antimony by heating.

Patent Application G.B. No. 2,104,432A discloses projection of abrasive particles on to substantially linear portions of silicon steel strip. The method is based on deformation of the metal underlying the surface to obtain domain refinement. As such, it is a variant of conventional mechanical scribing as defined in the foregoing and is vulnerable to removal by stress-relief annealing. In other words, it is not heat-proof. U.S. Pat. Nos. 4,680,062 and 4,737,203 use very high Pressure fluid jets (e.g. 30,000-60,000 psi) to cut grooves by employing solely a liquid or a fluid-abrasive medium. The method is another variant of conventional mechanical scribing involving mechanical deformation of the underlying metal layers. Its advantage over other similar methods (e.g. G.B. No. 2,104,432A referred to above) lies in the usage of high abrasive pressures and the resultant practical advantage of increased cutting speed. The associated domain-refinement, by virtue of mechanical deformation, is not heat resistant.

It should be noted that the degree of surface penetration is not always a reliable indicator of the extent of underlying metal damage. For example, a water-knife (e.g. U.S. Pat. No. 4,680,062 referred to above) with no abrasive and high pressure may cause considerable under-surface metal damage in cutting a groove. In contrast a lighter pressure jet with sharp abrasives may cause maximum superficial surface grooving with little damage to underlying metal.

Copending applications Ser. No. 205,711, filed June 10, 1988, now U.S. Pat. No. 4,904,313 and Ser. No 206,152, filed June 10, 1988, now U.S. Pat. No. 4,911,766 by the Assignee of this invention discloses specific methods for refining the magnetic domain wall spacing of grain-oriented silicon steel using certain metal and non-metal contaminants.

What is needed is a convenient and inexpensive method for removing the base coating in desired patterns in a method of refining the magnetic domain wall spacing of grain-oriented silicon steel with minimal deformation of the underlying metal. The method should be compatible with conventional processing of regular and high permeability silicon steels, should make use of the thermally insulative coating on the sheet, and should be suitable for subsequent techniques to develop domain refinement by chemical rather than mechanical means so that the domain refinement is heat proof.

BRIEF SUMMARY OF THE INVENTION

It is the object of the present invention to provide a method of domain refinement of grain-oriented silicon steel. The invention entails breaking through the very thin outer layer of insulating coating. Forming a precise pattern of stripes by a scribing procedure using a minimal pressure gas-fluid abrasive treatment at substantially zero damage to the metal underneath the superficial coating. Once bare metal stripes are thus exposed the steel is in a condition to be chemically striped to obtain heat-proof domain refinement.

DETAILED DESCRIPTION OF THE PREFERRED EMBODIMENTS

In general terms, in accordance with the teaching of the present invention the scribing, in a direction substantially transverse to the rolling direction to obtain domain refinement of grain-oriented silicon steel strip after finally rolled, is accomplished by subjecting one side of the strip to a low pressure air-fluid abrasive mixture to abrade away the necessary 5-micron thick stripes in the insulation forsterite coating to create a predetermined pattern on one of the surfaces of the strip.

Figure 4:
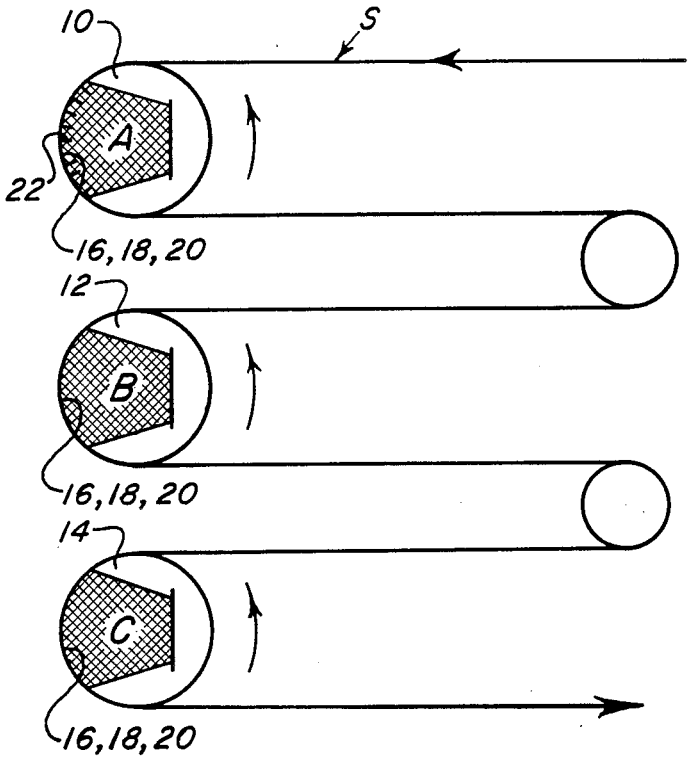
FIG. 4 is a schematic elevational view of a continuous abrasion system employing three hydroblast drums according to the teaching of the present invention.

The low pressure air-fluid abrasion treatment can be preformed by a unit generally similar to a well known hydroblast unit commonly found in laboratories to produce a mild form of abrasion in which anything of a high elastic nature, such as rubber, is minimally affected by the blast and which is utilized in either a non-continuous abrasion arrangement or in a continuous abrasion arrangement of FIG. 4, more about which will be discussed hereinafter, both arrangements employing an air-liquid abrasion treatment.

Grain-oriented silicon steel used in the herein disclosed tests was produced by casting, hot rolling, normalizing, cold rolling to intermediate gauge, annealing and cold rolling to final gauge, decarburizing, and final texture annealing to achieve the desired secondary recrystallization of cube-on-edge orientation. Typical melts of nominal initial composition of conventional (Steel 1) and high permeability (Steel 2) grain-oriented silicon steels were:

| | ELEMENTS | | | | | | | |
|---|---|---|---|---|---|---|---|---|
| | C | N | Mn | S | Si | Cu | B | Fe |
| Steel 1 | 030 | <50 ppm | .07 | .022 | 3.15 | .22 | — | Bal. |
| Steel 2 | 030 | <50 ppm | .038 | .017 | 3.15 | .30 | 10 ppm | Bal. |

After final texture annealing, the C, N, and S were reduced to trace levels of less than about 0.001%. The strip was cut into numerous pieces to produce samples of sizes sufficient for processing in accordance with the present invention. Final sample size for magnetic testing was that of the well known Epstein strip of 30 cm. long×3 cm. wide. Epstein strips were tested both as stacked packs and as single strips as indicated.

The method of the present invention takes into consideration the fact that the layer of forsterite required to be broken through is very thin and can be penetrated easily and quickly, when applying a relatively low pressure air-fluid abrasive mixture. The abrasive mixture is applied to the forsterite surface in the precise pattern of lines needed for a subsequent chemical striping treatment to develop heat-proof domain refinement. As used herein, the pattern of exposed bare metal lines is sometimes referred to as "metal stripes".

In the development of the invention a laboratory hydroblast unit was employed for the experiments conducted. The unit used water and 100 mesh silica, mixed and propelled by compressed air at a pressure of up to 100 psi through a 5/16 inch diameter nozzle. The water-silica will take the form of a slurry having by weight a range from 130 to 150 grams per 100 ML and the silica comprising from 35% to 55% of the slurry.

Figure 1:
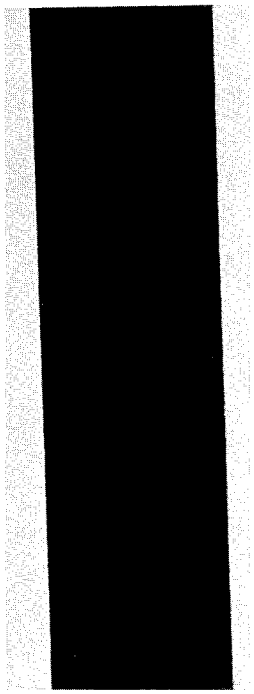
FIG. 1 is a photomicrograph of the surface of a test specimen after hydroblasted according to the teaching of the present invention with partial masking in the center to produce bare metal stripes.

The experiments were on texture-annealed 30cm×3 cm Epstein strips with thickness as indicated in the individual tests. In order to abrade the correctly dimensioned and spaced stripes, stencils were built up on the samples using a ¼ inch wide plastic adhesive tape of the type marketed for label making. A short length of Epstein strip was masked and arbitrarily given a 1 minute treatment with the nozzle about 4 inches from the taped area of the strip. After removing the tape the sample was dipped in a copper sulfate solution which electrolessly plated out copper on iron but not on forsterite. As shown in FIG. 1, the forsterite had been abraded away except where masked. After this, full length Epstein strips were masked and abraded for phosphorus striping. The plastic "label" tape held up well and retained much of its initial sheen through the abrading operation. This point is emphasized as illustrative of the mildness of the abrading operation.

Samples of Steel 2 conditioned by abrading then subjected to subsequent processing to effect domain refinement by attacking the base metal stripe with phosphorus vapor. This heat resistant domain refining process of phosphorus-striping was done in accordance with the teachings of the above mentioned copending application, Ser. No. 206,152, (now U.S. Pat. No. 4,911,766) by the Assignee of this invention. This application discloses a method for refining the domain wall spacing of final texture annealed grain-oriented silicon steel by applying a phosphorus contaminate to a pattern of exposed steel being free of thermal and plastic stresses. The phosphorus-striping process includes phosphorus vapor being generated at or near the strip surface, for example by hydrogen reduction of a phosphate coating. The phosphorus migrates to any exposed iron (such as the metal stripes), attacks the iron, and forms wedge-shaped phosphide particles. The forsterite is protective and is not attacked.

A source of phosphorus or phosphate-base coating having the following:

Composition was applied either directly to the abraded strips or to similar un-abraded dummy strips:

| "P" COATING | |
|---|---|
| Phosphoric Acid | 118 gm/1 |
| Magnesium Oxide | 18 gm/1 |
| Ammonium Hydroxide (58%) | 20 gm/1 |
| Chromium Dioxide | 34 gm/1 |
| Dupanol (2%) | 1 gm/1 |
| Water | Balance |

The coated metal strip samples were air dried for 1 minute at 800°-1475° F. (427°-802° C.). Total coating thickness (both sides) was about 0.1 mil.

Strips were assembled in one of two ways for the phosphorus-stripe operation. In one case the abraded strips to which the phosphate coating had been applied the procedure consisted simply of stacking the strips one on top of another. For un-coated abraded strips the stacking consisted of alternately stacking an abraded strip with a dummy coated strip with a thin sprinkling of alumina in between adjacent strips to prevent direct contact. In both cases the packs were heated in hydrogen for five hours at 1650° F. (899° C.) to chemically reduce the phosphate coating and release phosphorus vapor. In one case the vapor originated from the surface of the test strips itself while in the second case (more akin to classical vapor deposition) the vapor originated from an external source, namely the adjacent dummy strips.

Results on two samples abraded and phosphorus-striped by vapor deposition from adjacent dummy strips are given in Table I below. The strips had been abraded 3 minutes each at 90 psi pressure. As shown by the magnetic property values, the abrasion had not only removed the forsterite but had also stressed the underlying metal, producing a considerable lowering of the core loss. The improvement was generally similar to the results of the well known mechanical scribing effect accomplished in this instance by abrading. On stress relief annealing (Column C of Table I) beneficial effect of the mechanical-scribing was, as expected, lost and properties returned substantially to their starting values. However the material now had the exposed metal stripes, and, when attacked by the phosphorus vapor, the core losses decreased, in point of fact to approximately the same level as for the mechanically scribed condition. Importantly, the losses were now heat-proof.

TABLE II

| | Abrasion scribing followed by phosphorus striping Second pair of samples | | | | | | | | | | | |
|---|---|---|---|---|---|---|---|---|---|---|---|---|
| | Initial Properties As-scrubbed | | | Masked and Lightly Hydroblasted | | | P coated; cured for 45 secs. at 1475° F. | | | phosphorus surface stripe/10 hr/1650° F. | | |
| Ident. | Mu10 | P1.5 | P1.7 | Mu10 | P1.5 | P1/7 | Mu10 | P1.5 | P1.7 | Mu10 | P1.5 | P1.7 |
| HB9 | 1940 | .485 | .680 | 1939 | .478 (−1%) | .633 (−7%) | 1940 | .489 (+1%) | .669 (−2%) | 1922 | .406 (−16%) (−20%) | .546 |
| HB10 | 1927 | .526 | .720 | 1923 | .505 (−4%) | .684 (−5%) | 1909 | .541 (+3%) | .747 (+4%) | 1912 | .423 (−20%) (−22%) | .563 |
| | | A | | | B | | | C | | | D | |

Numbers in parentheses indicate % change from original
Starting Matl. texture annealed Epstein strips (Steel 2)

TABLE I

| | | | | Abrasion scribing followed by phosphorus striping First pair of samples | | | | | | | | |
|---|---|---|---|---|---|---|---|---|---|---|---|---|
| Sample | Initial Properties As-scrubbed | | | Masked and Hydroblasted | | | SRA 1500° F. Nitrogen | | | Phosphorus vapor-stripe/5 hr/1650° F. | | |
| Ident. | Mu10 | P1.5 | P1.7 | Mu10 | P1.5 | P1.7 | Mu10 | P1.5 | P1.7 | Mu10 | P1.5 | P1.7 |
| HB4 | 1921 | .494 | .666 | 1910 | .386 (−22%) | .534 (−20%) | 1920 | .487 (−1%) | .655 (−2%) | 1913 | .386 (−22%) (−21%) | .523 |
| HB5 | 1926 | .460 | .647 | 1909 | .410 (−11%) | .551 (−15%) | 1926 | .468 (+2%) | .655 (+1%) | 1918 | .396 (−14%) (−14%) | .555 |
| | | A | | | B | | | C | | | D | |

Where: Mu10 = permeability at 10 Oe; P1.5, P1.7, = core loss at 1.5 T and 1.7 T respectively in W.P.P.
Numbers in parentheses indicate % change from original
Starting Matl. texture annealed 8 mil thick Epstein strips of Steel 2

For a second pair of samples, documented in Table II below, the starting procedure was much the same except that the hydroblast treatment used was not so severe. Time of treatment was reduced by a factor of four to 1 minute per sample, retaining the same 90 psi pressure. This milder treatment (the idea being to remove essentially only the forsterite) resulted in a virtual absence of the mechanical scribe effect (Column B of Table II). The improvement averaged only −4% compared with −17% in the more heavily abraded first pair of strips. The second pair was not stress relief annealed at this stage (as was the first pair). However, during the next process of applying a phosphate coating (P coating) curing at 1475° F. (802° C.) relieved some of the small residual stresses present. After P coating the loss change averaged −2% compared with the original. Hence, the second samples were in essentially the same position as with the first pair after stress-relief anneal. The difference was that the second pair had the phosphorus source already in place in the form of the P coating. It remained to apply a final anneal in hydrogen to release surface phosphorus and complete the phosphorus striping. Average loss improvement was −20%, about the same as for the first pair. The second pair had not been through the mechanical-scribe improvement stage, demonstrating once more the independence of the chemical-striping core loss improvement from any prior core loss characteristics that were induced by scribing.

In still additional experiments, an 8-strip pack was processed. Properties were monitored both as single strips and as packs. The procedure was much as already described. It was again attempted to minimize the severity of the hydroblast to just cut through the forsterite. For the phosphorus-striping, the phosphate P coating was employed, as in the above second set of samples, as the phosphorus source.

Figure 2:
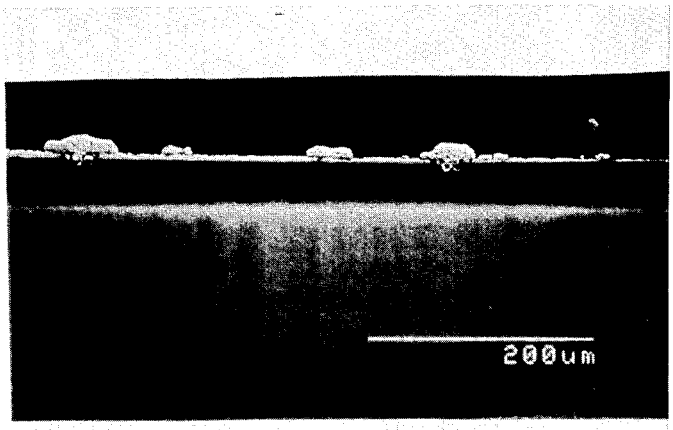
FIG. 2 is a 200X photomicrograph of the surface of a test specimen after hydroblasted according to the teaching of the present invention, and thereafter phosphorus striping showing a domain image pattern.
Figure 3:
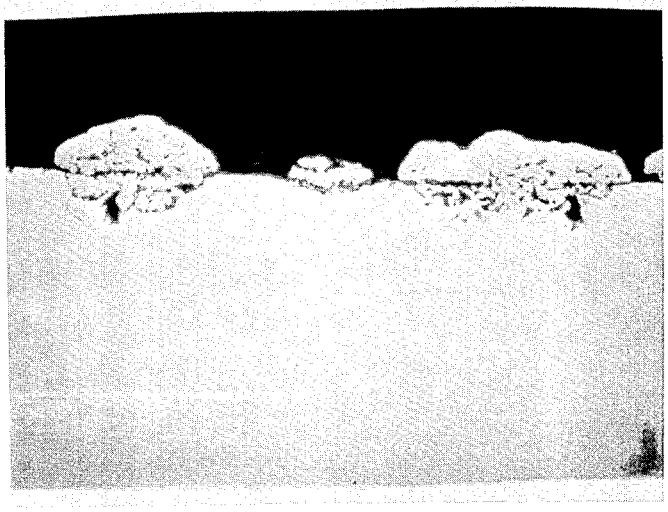
FIG. 3 is a 600X photomicrograph in transverse cross-section of the surface of a test specimen of an abraded band treated in accordance with the teaching of the present invention after 10 hours/1650° F./hydrogen phosphorus stripe treatment.

Properties of the set are shown in Table III below. Immediately apparent is that the goal of "light hydroblasting" with minimal "mechanical scribing" was only partially met. There was an improvement in average losses after hydroblasting of 8–12%. On phosphorus striping, emphasizing that this will anneal out the beneficial "mechanical scribe" contribution, the loss improvement was considerable. Core loss improvements averaged between 15 and 20%. The domain structure of one of the better quality strips was examined by domain-imaging. FIG. 2 is a reproduction and illustrates the refined domain structure developed. Cross-sections of the abraded stripes after phosphorus treatment were examined on the Scanning Electron Microscope. The appearance (FIG. 3) was somewhat different to what experience had lead to expect in scribed and phosphorus treated samples. Previously, using mechanical, laser, or electron-beam scribing to make the initial marks, lines were found of wedge-shaped phosphides crowding the scribe grooves. In contrast the hydroblast grooves contained sporadically spaced rosettes of phosphides. They were all within the confines of the abraded line but this was considerable wider (>5 mils wide) than with the other scribing methods described above.

Although the available phosphorus had a much larger deposition area available than with the other scribing methods, it is interesting to observe that the phosphorus appeared to nucleate phosphide "wedges" and aggressively attacked at these points leaving other nominally identical potential attack areas untouched. It is felt that the characteristic of the phosphides of driving deep "wedges" into the steel probably contributes favorably to their excellent capacity to affect domains. To be noted also is the fact that the phosphide contains about 84% iron so, although on a microscopic scale, there must be significant movement of iron from relatively deep in the matrix steel towards the surface. This again could contribute to the effect on the domains. A "downside" to this tendency for the phosphides to form deep wedges and rosettes is that the same aggressiveness of the reaction is manifested in growth upwards out of the steel. Phosphides can readily be nucleated below strip surface level and rapidly grow up to above surface level as well as down into the steel matrix. An example is found in the micrograph in FIG. 3 of a phosphide protruding over half a mil out of the strip surface.

TABLE III

| Strip No. | Properties of abraded and phosphorus striped 8-mil strips of Steel 2 | | | | | | | | |
|---|---|---|---|---|---|---|---|---|---|
| | Initial Properties As-scrubbed | | | Hydroblasted | | | Hydroblast plus phosphorus-stripe* | | |
| | Mu10 | P1.5 | P1.7 | Mu10 | P1.5 | P1.7 | Mu10 | P1.5 | P1.7 |
| M-5-3/82 | 1906 | .447 | .637 | 1898 | .380 | .554 | 1884 | .388 | .558 |
| M-5-3/83 | 1945 | .391 | .558 | 1934 | .363 | .510 | 1923 | .339 | .471 |
| M-5-3/84 | 1943 | .370 | .531 | 1929 | .366 | .523 | 1901 | .346 | .488 |
| M-5-3/85 | 1917 | .471 | .652 | 1907 | .416 | .582 | 1901 | .393 | .554 |
| M-5-3/86 | 1928 | .453 | .641 | 1920 | .395 | .555 | 1906 | .383 | .528 |
| M-5-3/87 | 1956 | .507 | .697 | 1945 | .392 | .551 | 1932 | .340 | .480 |
| M-5-3/88 | 1951 | .394 | .545 | 1941 | .343 | .470 | 1925 | .328 | .446 |
| M-5-3/89 | 1933 | .543 | .765 | 1924 | .481 | .684 | 1910 | .377 | .516 |
| Ave. SS | 1935 | .477 | .628 | 1925 | .392 (−12%) | .554 (−12%) | 1910 | .363 (−19%) | .505 (−20%) |
| | | | | | c.f. Orig. | | | c.f. Orig. | |
| Pack Test | 1943 | .420 | .577 | 1934 | .381 (−9%) | .529 (−8%) | 1921 | .357 (−15%) | .492 (−15%) |
| | | | | | c.f. Orig. | | | c.f. Orig. | |

*Phosphorus-stripe heat trt. 5-10 hrs. at 1650° F. hydrogen Starting Matl. texture annealed Epstein strips It is considered that the data appearing above show the hydroblast method to work well for drawing lines through the forsterite to prepare for chemical striping. A number of methods of scribing by abrasion have been published for example in U.S. Pat. Nos. 4,513,597; 4,680,062 and 4,737,203 and U.K. Patent No. GB 2,104,432. An arrangement according to the present invention is shown schematically in FIG. 4, in which there is illustrated a cluster of three hydroblast drums 10, 12, and 14 around which the strip continuously traverses. Each drum has a predetermined number of longitudinal slits 16, 18, and 20 at predetermined intervals along its circumference over which predetermined portions of the moving strip passes over nozzles 22, shown only as to the drum 10. In the three-drum cluster shown the intervals are approximately ¾ inch. Each of the drums have, internally, at least one hydroblast type gun, although several guns may be employed, having fields marked A, B, and C to service the slits over which the strip traverses. The drums are lined inside with some rubber-like material to minimize internal wear. The rotational movement of the drums are mutually synchronized so that at a given instance the lines being drawn by each drum would be offset with respect to a neighboring drum by approximately ¼ inch. The angular relation synchronized so that lines drawn by unit 12 are approximately ¼ inch in advance of unit 10 and likewise unit 14 with respect to 12.

After passing over all three drums, the strip would have transverse lines at approximately ¼ inch intervals as practiced in conventional scribing. The reason for employing a cluster of drums instead of just one is for engineering design considerations. Although synchronization may introduce a potential problem, it is considered that this would be more than offset by being able to use a much simpler design for each drum. Within each drum, the scribing lines are arranged at approximately ¾ inch intervals which will present a less complicated design than scribing in a single drum unit at approximately ¼ inch intervals. The strip marked S in FIG. 4 may be advanced through the drums by a well known strip tension machine, the strip typically being 30 to 48 inches wide and of a gauge of 7 to 9 mils.

The blasting mechanism of the hydroblast drums may take the general form of type E Z Hydro-Finish System supplied by the Pangborn Corporation, in which the gun or guns of each drum are part of a hydroblasting system, including a container of abrasive slurry adapted to be agitated by a pump and a means for supplying and controlling the desired proportion of water and abrasion making up the slurry fed to the gun or guns under the desired air-liquid blasting pressure.

As can be seen from the above, the main object of the present invention namely the exposing of the bare metal lines in preparation for chemical striping has been realized. In the present improvement it has been demonstrated that in preparing for chemical striping, removal of only a minimal amount of material is necessary, and that it is unimportant whether or not the removal is sufficiently severe to produce the well known mechanical scribing effect on magnetic properties. If the latter occurs it is (a) substantially removed during curing of the phosphate (phosphorus-source) coating or (b) automatically completely removed during the course of the 1650° F. diffusion anneal applied as part of the chemical striping process.

The present invention provides a method and means whereby low pressure abrasion scribing is an inexpensive way of preparing strip for chemical striping. Properties obtained using a combination of low pressure abrasion and phosphorus striping are summarized below:

| | Epstein Packs | | | | | |
|---|---|---|---|---|---|---|
| | Initial as-scrubbed | | | Hydroblast-patterned + phosphorus stripe | | |
| | Mu10 | P1.5 | P1.7 | Mu10 | P1.5 | P1.7 |
| Steel 2 8-mil | 1043 | .420 | .577 | 1921 | .357 (−15%) c.f. Orig. | .492 (−15%) |
| Steel 1 7-mil | 1862 | .401 | .615 | 1864 | .382 (−5%) c.f. Orig. | .594 (−3%) |

Although a preferred and alternative embodiments have been described, it will be apparent to one skilled in the art that changes can be made therein without departing from the scope of the invention.

We claim as our invention:

1. In a method of heat-proof domain refinement of grain-oriented silicon steel in the form of a final texture annealed sheet having a layer of insulation coating on its outer surface, the steps of:

abrading said layer of the sheet in a manner to form a predetermined pattern of spaced parallel stripes, said abrading including the step of applying a relatively low pressure air-liquid abrasive mixture sufficient to remove said layer with substantially no surface damage to the metal as evidenced by minimal effects on magnetic properties, said abrasive mixture comprises a liquid and an abrasive propelled by air pressure of up to 100 psi.

2. In a method according to claim 1, wherein said steel constitutes a grain-oriented steel having a silicon contents of 2.5 to 4 percent.

3. In a method according to claim 1, wherein said layer consist of a forsterite base coating approximately 5 microns in thickness.

4. In a method according to claim 1, wherein said pattern is designed to prepare the sheet for a required chemical striping treatment to develop said heat-proof domain refinement.

5. In a method according to claim 1, wherein said abrasive mixture comprises water and approximately 100 mesh silica propelled by an air pressure of approximately 80 to 100 psi though approximately a 5/16 inch diameter nozzle.

6. In a method according to claim 1, wherein said abrasive mixture comprises water and silica in a slurry having by weight a range from approximately 130 to 150 grams per 100 ML of water and the silica comprising approximately from 35% to 55% by weight of the slurry.

7. In a method according to claim 1, wherein said abrading step includes applying by a hydroblast unit to produce a number of substantially transverse parallel spaced lines to form said pattern, and said method further includes the additional step of advancing the sheet relative to said unit in a manner to form said pattern.

8. In a method according to claim 6, wherein a number of said units are arranged at operative spaced intervals along the path of the direction of travel of the sheet, the additional step of advancing the sheet continuously relative to said units so as to subject the sheet to a number of different sets of discrete abrasive parallel lines, in which each said unit is arranged to form at least one different line of a set.

9. In a method according to claim 7, wherein said discrete abrasive lines are transversely disposed across the sheet at approximately ¼ inch intervals.

10. In a method of heat-proof domain refinement of grain-oriented silicon steel having a silicon contents of 2.5 to 4 percent in a form of a final texture annealed sheet and having a layer of insulation coating on its outer surface of a forsterite base coating approximating 5 microns in thickness, the steps of:

abrading said layer of the sheet in a manner to form a predetermined pattern of spaced parallel stripes designed to prepare the sheet for a required chemical striping treatment to develop said heat-proof domain refinement, said abrading including the step of applying a relatively low pressure air-liquid abrasive mixture sufficient to remove said layer with substantially no surface damage to the metal as evidenced by minimal effects on magnetic properties, wherein said abrasive mixture comprises water and approximately 100 mesh silica propelled by an air pressure of approximately 80 to 100 psi though approximately a 5/16 inch diameter nozzle, said abrading step including applying said abrasive mixture by a number of hydroblast units in a manner to produce a number of substantially transverse parallel spaced lines, said units being arranged at operative spaced intervals along a direction of travel of the sheet, advancing the sheet continuously relative to said units in a manner to form said pattern by subjecting the sheet to a number of different sets of discrete abrasive parallel lines, in which each said unit is arranged to form at least one different line of a set.

* * * * *